United States Patent [19]

Jarvis, Jr. et al.

[11] 3,951,683

[45] Apr. 20, 1976

[54] WATER DISTRIBUTION SYSTEM FOR DISHWASHING APPLIANCE

[75] Inventors: Wilbur W. Jarvis, Jr., St. Joseph; Leslie Toth, Coloma, both of Mich.

[73] Assignee: Whirlpool Corporation, Benton Harbor, Mich.

[22] Filed: Aug. 5, 1974

[21] Appl. No.: 494,893

[52] U.S. Cl. ..... 134/144; 134/176; 134/191

[51] Int. Cl.[2] ..... B08B 3/02

[58] Field of Search ..... 134/176, 179, 191, 144, 134/148

[56] References Cited

UNITED STATES PATENTS

| | | | |
|---|---|---|---|
| 3,009,470 | 11/1961 | Zurek | 134/176 |
| 3,064,665 | 11/1962 | Martiniak | 134/176 |
| 3,213,866 | 10/1965 | Martiniak | 134/176 X |
| 3,253,784 | 5/1966 | Long et al. | 134/176 UX |
| 3,370,869 | 2/1968 | Dutcher | 134/176 X |
| 3,375,835 | 4/1968 | Lopp et al. | 134/176 |
| 3,785,566 | 1/1974 | Jenkins | 134/179 X |

*Primary Examiner*—Robert L. Bleutge
*Attorney, Agent, or Firm*—Hill, Gross, Simpson, Van Santen, Steadman, Chiara & Simpson

[57] ABSTRACT

An apparatus for distributing wash liquid to a spray device which is located above a dish-supporting rack in a dishwashing appliance, the apparatus including a vertical hollow tower having an open lower end fixedly attached to the rack, means for rotatably mounting the spray device onto an apertured upper end of the tower so that there is fluid communication between the tower and the spray device, and a fluid-expansible coupling member located below the rack and having an upper opening below and substantially concentric with the open lower end of the tower. A hub assembly supports the coupling member on a pump means which forces wash liquid through the hub assembly and into the coupling member to expand it into a sealing contact with the tower at the open lower end of the tower so that fluid flows through the tower to the spray device.

6 Claims, 6 Drawing Figures

WATER DISTRIBUTION SYSTEM FOR DISHWASHING APPLIANCE

REFERENCE TO RELATED APPLICATION

This application has features in common with the copending application of Paul J. LaPrad, Chester W. Wassilak, and Philip P. Johnson, Ser. No. 494,894 filed concurrently herewith and assigned to the same assignee as the present application.

BACKGROUND OF THE DISCLOSURE

1. Field of the Invention

The present invention relates to dishwashing appliances and more particularly to a liquid distribution system for a spray device within such an appliance.

2. Prior Art

Dishwashing appliances which have a rotatable spray device located above a dish-supporting rack and which include a liquid distribution system for directing liquid from a pressurized liquid source to the spray device for distribution of wash liquid over dishes, pots, pans, etc., placed in a supporting rack within the washing chamber of the appliance are known.

Some of such appliances include an upper and lower dish-supporting rack which are separably movable into and out of the washing chamber of the appliance for the loading and unloading of dishes, etc. Each dish-supporting rack is generally located adjacent at least one spray device, and positioned so as not to interfere with rack movement. A liquid distribution system provides wash liquid to each of the spray devices which are generally of the reaction type, that is, caused to rotate by the reaction force of pressurized wash liquid exiting through apertures therein. U.S. Pat. Nos. 3,009,470 and 3,064,664 both disclose an appliance such as just described, with a liquid distribution system which, at least during operation, forms a unitary structure with upper and lower spray devices. Fluid pressure in the associated water distribution system is required to rotate both spray devices. Even with relatively lightweight materials, such as sheet metal or plastic, such an overall unitary structure has considerable mass and therefore requires relatively large expenditures of fluid pressure which is then not available for scouring and otherwise washing the dishes, etc., within the appliance. Further, unitary rotatable liquid distribution systems are relatively complex to manufacture and install and are also difficult to service and maintain in proper working order, rendering appliances containing such systems uneconomic.

U.S. Pat. No. 3,370,869, issued to I. G. Dutcher on Feb. 27, 1968 and assigned to the assignee of the present invention, discloses and claims a partial solution to the above-noted drawbacks in certain dishwashing appliances. As shown therein, a spray device can be inexpensively mounted for rotation on a fixed-hub fluid distribution system, at least in instances where there is no requirement for periodic separation of the spray device from its associated liquid distribution system, such as required when the spray device is located above a dish-supporting rack and must be separated from its liquid distribution system to permit movement of this lower rack from the washing chamber for loading or unloading dishes, etc.

U.S. Pat. No. 3,785,566, issued to Thomas E. Jenkins on Jan. 15, 1974, discloses an example of the use of an expanding seal member to provide a fluid passageway joining the pump outlet and a lower spray device in a dishwashing appliance.

SUMMARY OF THE INVENTION

The invention provides a highly reliable and highly economical liquid distribution system including a spray device located above a dish-supporting rack in a dishwashing appliance. The invention enables wash liquid to be piped directly under its full pressure to such spray device and also allows the rack to be withdrawn from the appliance without interference for loading unloading dishes, pots, pans, etc.

The invention accomplishes these and other features by associating reaction-type spray devices with a fixed water-distribution system.

In certain embodiments of the invention, a vertically-extending stationary hollow tower member having an open lower end is fixedly attached to a lower rack for supporting dishes so as to extend above the rack, a reaction-type spray device is rotatably mounted on an apertured upper end of the tower member so that there is fluid communicating between the tower and the spray device, and a non-rotating expansible, bellows-like coupling member is positioned below the rack and has an upper opening below and substantially concentric with the open lower end of the tower. A stationary hub assembly supports the coupling member on an outlet of a pump, and wash liquid is forced upwardly through the hub assembly into the coupling member, expanding it into a sealing contact with the lower end of the tower so that wash liquid can flow from the pump through the tower and into the spray device for distribution onto dishes, etc. within the washing chamber of the appliance. A second dish-supporting rack may be positioned above the upper end of the tower member so that the spray device distributes wash liquid onto dishes within a plurality of dish-supporting racks.

In certain preferred embodiments of the invention, an additional spray device is rotatably mounted on the fixed hub assembly so that wash liquid is distributed over the lower dish-supporting rack from above and below the rack for improved washing of dishes, etc. therein.

DESCRIPTION OF THE PREFERRED EMBODIMENTS

Figure 1:
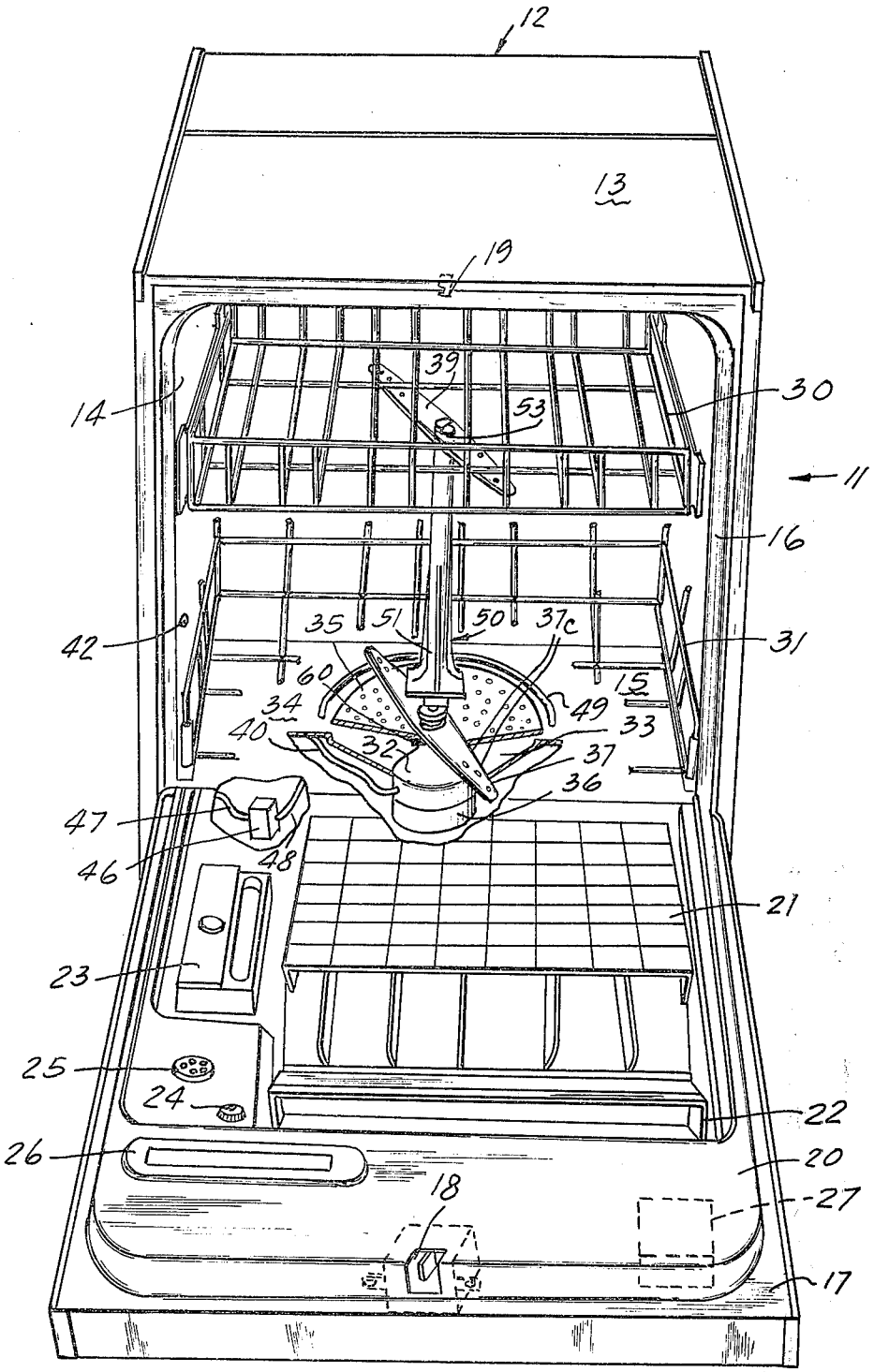
FIG. 1 illustrates a front-loading dishwashing appliance with portions broken away for purposes of illustration, and which includes a certain embodiment of the invention.

The principles of the invention will be described in relation to a two-rack portable dishwashing appliance, such as a front-loading dishwashing machine generally indicated at 11 in FIG. 1.

Figure 2:
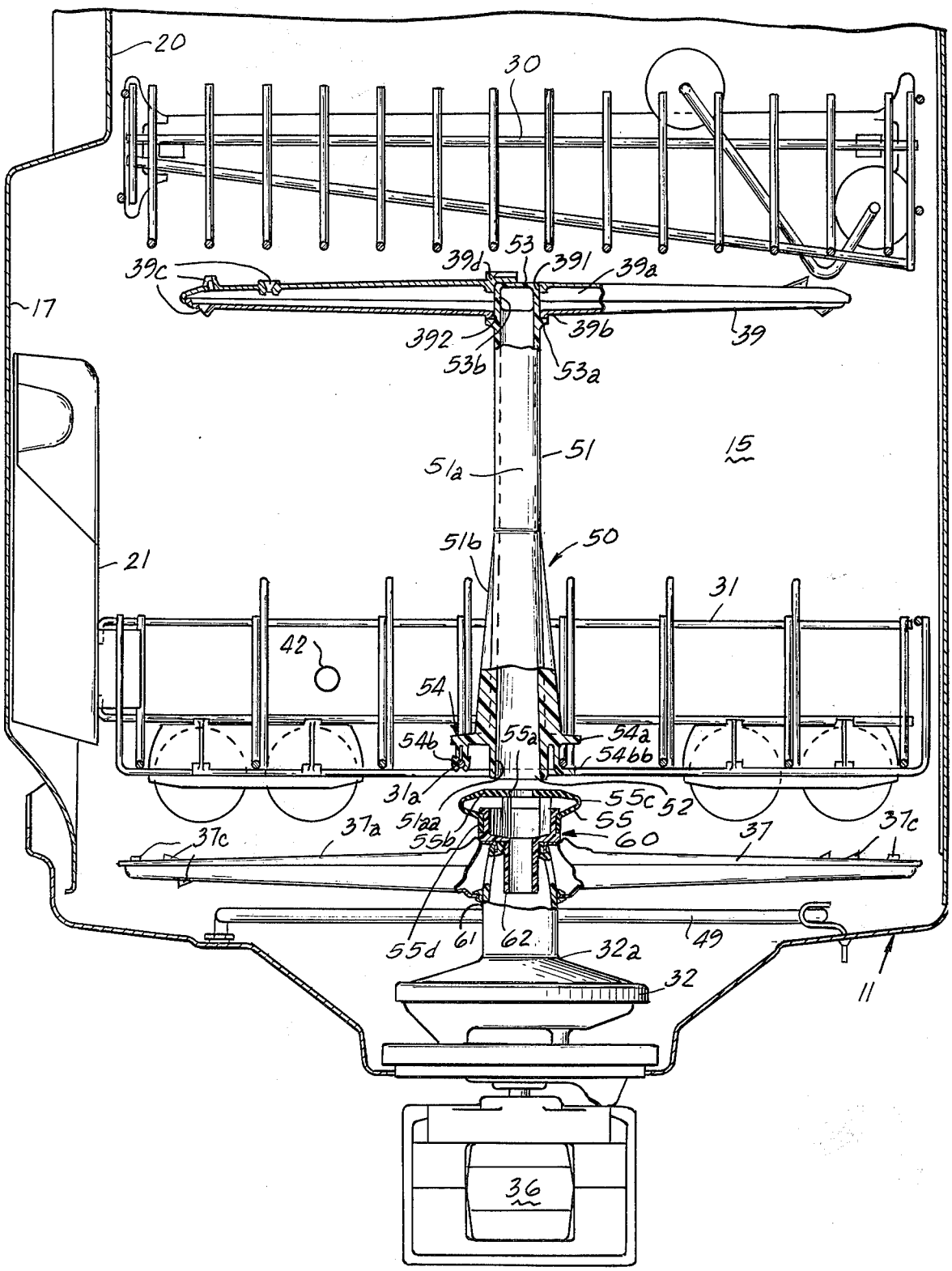
FIG. 2 is a partial cross-sectional view, with portions in elevation, of an embodiment of the invention mounted within a dishwashing appliance with portions of the structure broken away to illustrate details.

The front-loading dishwasher 11 has a cabinet 12 with a top 13. The cabinet 12 is provided with an opening 14 on one side which allows entry into the washing chamber or enclosure 15. To close the opening 14, a closure, such as a hollow door 17 is pivotally connected to a bottom front portion of the cabinet 12 and is movable from the position illustrated in FIG. 1 to a position closing the opening 14, as best seen in FIG. 2. The opening 14 is provided with a seal or gasket 16, which extends completely around the periphery of the opening. The door 17 is provided with a latching mechanism 18, which coacts with a strike 19 disposed at an edge of the opening 14 for latching the door in the closed position during which an inner panel 20 of the door 17 tightly engages the gasket 16 to provide a seal to prevent leakage of liquid from the chamber 15.

As illustrated, the inner panel 20 of the door 17 has mounted thereon silverware baskets 21 and 22, a detergent dispenser 23, a rinse additive dispenser which has a filling cap 24, a discharge opening 25, and a vent opening 26 which allows hot humid air to escape from the chamber 15 during a drying cycle. Mounted in the hollow door 17 beneath the panel 20 is a timer 27 which is utilized to control the various cycles of dishwasher operation including washing, draining, rinsing, drying, and dispensing of the detergent and rinse additives.

Within the washing chamber 15 are movable upper and lower dish-supporting racks 30 and 31 respectively. To provide a supply of wash or rinse liquid under pressure for distribution onto the dishes in the racks 30 and 31, a pump 32 is disposed in a recess or depressed sump area 33 in a bottom wall 34 of the chamber 15. To remove food particles from the liquid and prevent their recirculation by the pump, the sump 33 is provided with a filter screen 35. The pump 32, which is driven by a motor 36, has two pump chambers (not shown). One of these pump chambers provides wash liquid under pressure through a hub 60 to a lower spray device 37 and also, through the hub 60, to a liquid distribution means 50 which has an upper spray device 39 mounted thereon. The other pump chamber of pump 32 pumps the wash liquid, during a drain-out or pump-out portion of the cycle, through a discharge conduit 40 which is connected to a suitable discharge conduit of the dishwasher 11. Water enters the washing chamber 15 through an inlet opening 42 which is connected by a hose or conduit 47 to a water inlet control or valve 46. The water inlet control is in turn connected by a conduit 48 to a source of water under pressure, such as a household faucet or the like, and delivery of water to the washing chamber 15 is thus controlled by the water inlet control 46. A heating element 49, of the sheathed electrical resistance type, is provided in the chamber 15 to heat the washing liquid during the wash cycle and to heat the air within the washing chamber during a drying cycle.

The liquid distribution system or apparatus 50 includes a stationary hollow vertical tower 51 having an open lower end 52 fixedly attached by fastening means 54 to the lower dish-supporting rack 31 so as to extend a select distance above the rack 31. The tower 51 is provided with an apertured upper end 53, with apertures **53*b* providing fluid communication from the interior chamber 51*a* of the tower 51 to the upper spray device 39. The body of tower 51 comprises a hollow tube member constructed of a suitable heat-resistant and detergent and wash liquid-resistant material, such as a thermoplastic material, for example, polypropylene and includes a plurality of reinforcing rib-like projections 51*b* which extend radially outwardly from the tower 51. Fastening means 54 are integrally formed on the outer lower wall of tower 51 and generally comprise an annular radially-extending flange 54*a* (best seen in FIGS. 2, 3 and 5) having a depending clip-like attachment 54*b* along one side of tower 51 and a depending hook-like attachment 54*bb* along another side of the tower 51. The attachments 54*b* and 54*bb* engage individual wire strands 31*a*, 31*a* of rack 31 and prevent misalignment of the tower during dishwashing or dish handling operations. In this manner, the tower 51 is readily attached in fixed relation to the rack 31 and is readily movable with the rack 31 when the rack is moved out of and into the washing chamber 15 of the dishwasher 11. Further, a user of such a dishwasher will not accidentally misalign the tower 51 during loading or unloading of dishes from the appliance since fastening means 54 provide a secure and relatively fixed engagement between the tower 51 and the rack 31**.

The hollow spray device 39, preferably of the reaction-type, is rotatably mounted upon the apertured upper end of tower 51 so that there is fluid communication between the tower chamber **51*a* and the hollow interior 39*a* of the spray device 39. In preferred embodiments, the spray device 39 is provided with upper and lower openings 391 and 392 of equal diameter for receiving the tower, and this arrangement insures that there is no hydraulic unbalance and hence no unbalance forces which might cause the spray device 39 to separate from the tower 51 during operation. The spray device 39 is provided with a plurality of variously oriented apertures 39*c* for directing washing liquid under pressure in a plurality of directions toward racks 30 and/or 31** to scour, wash, rinse, etc. dishes placed within these racks.

A relatively simple mounting means may be provided for mounting the spray device 39 onto the tower 51. For example, as shown in FIG. 2, the tower 51 may be provided with ear-like projections **53*a* along the outer walls thereof and located in the vicinity of the apertured upper end 53 for rotatably supporting the spray device, and the spray device 39 may be provided with an annular downturned tab 39*b* for slidably contacting the upfacing surfaces of projections 53*a*. In addition, spray device 39 may be provided with the flange-like projection 39*d* along an upper surface of the spray device 39 located so as to at least partially overlap the central openings 391 and 392 of spray device 39 and contact a portion of the top surface of upper end 53 of tower 51. The projection 39*d* may function to distribute any wash liquid leakage between the tower and the spray device onto dishes in racks 30 and 31. In this manner, the spray device 39 is freely rotatable about tower 51 in response to pressurized wash liquid exiting from apertures 39*c*. The weight of the spray device 39, the weight of wash liquid inside chamber 39*a*, and the thrust of liquid from apertures 39*c* all cooperate to hold the spray device 39 on the tower 51**.

A stationary expansible coupling member 55 is located below the rack 31. The coupling member 55 is open at opposite ends thereof for fluid passage through the chamber defined by its side walls. An upper opening 55*a* is located in spaced concentric relationship with the open lower end 52 of tower 51. The coupling member 55 is mounted on the fixed hub 60 (best seen in FIGS. 2 and 3), which forms the upper part of pump outlet 32*a*.

The coupling member 55 is preferably constructed of a resilient heat and wash-liquid-resistant material, such as a rubber-like material, for example, neoprene, and formed into a bellows-like structure. The coupling member 55 is provided with an upper inwardly-extending annular wall 55*b* which defines upper opening 55*a*. The diameter of opening 55*a* is preferably smaller than the inner diameter of the open lower end 52 of tower 51. The upper wall 55*b* is joined by a curved side wall 55*c* to an axially-extending side wall 55*d*. The upper wall 55*b* is relatively thick in relation to walls 55*c* and 55*d*. This difference in thickness ensures that when pressurized wash liquid flows into the coupling member 55 and impinges against wall 55*b*, it will flex wall 55*c* from an unpressurized position to an extended or pressurized position and move wall 55*b* upwardly (best seen in FIG. 3) without objectionable distortion into sealing contact with the open lower end 52 of tower 51.

Figures 3, 4, 5, 6:
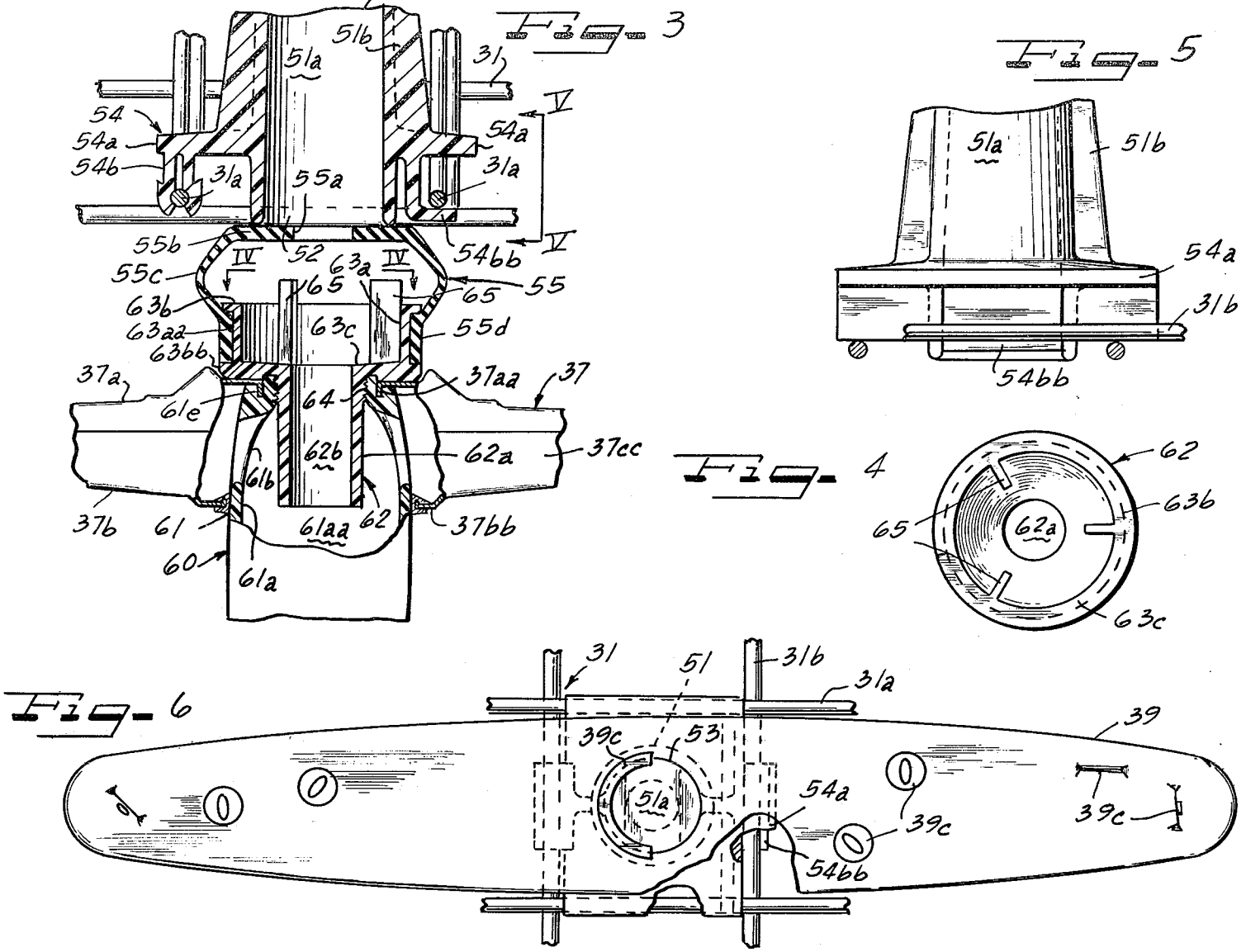
FIG. 3 is a partial fragmentary enlarged view illustrating the relative position of elements of the invention during a dishwashing operation.
FIG. 4 is a top sectional view taken along lines IV—IV of FIG. 3.
FIG. 5 is a partial side view taken along lines V—V of FIG. 3.
FIG. 6 is a partial top view, with portions broken away and portions in phantom illustrating a spray device mounted on a liquid distribution system in accordance with the principles of the invention.

The fixed hub 60 comprises a hub body 61 formed as a part of the pump outlet 32*a* and has an annular side wall 61*a*, an axial bore 61*aa*, and lateral outlet apertures 61*b*. The lateral outlet apertures 61*b* provide fluid communication between the interior of the hub assembly and the interior chamber 37*cc* of lower spray device 37, while wash liquid is received by the coupling member 55 through the top of the hub assembly. The hollow spray device 37, preferably of the reaction-type, is rotatably mounted on hub body 61. As best seen in FIGS. 2 and 3, the spray device 37 includes an upper surface 37*a* having a down-turned inner annular flange 37*aa* which is loosely received in an upwardly opening annular groove 61*e* in an upper portion of hub body 61. The spray device 37 also includes a lower surface 37*b* having an inner annular flange 37*bb* contacting the outer surface of hub body 61 and acting as a bearing surface against the hub body as the spray device 37 rotates.

The hub 60 also includes a nozzle means 62 which is affixed, as by thread means 64, to the upper portion of hub body 61, and the nozzle means 62 includes a depending neck portion 62*a* having a passage 62*b* concentrically aligned with axial bore 61*aa* of hub body 61 and with the upper opening 55*a* of coupling member 55. The passage 62*b* preferably has an inner diameter smaller than that of bore 61*aa* and about equal to that of opening 55*a*. The neck portion 62*a* extends downwardly within hub body 61 a select distance and preferably below the lateral outlet apertures 61*b*. A radially outwardly-extending sloped bottom wall 63*c* joins the neck portion 62*a* with an upwardly-extending annular wall 63*a*. The wall 63*a* is provided with upper and lower outwardly projecting flanges 63*b* and 63*bb* respectively so as to define an annular groove 63*aa* on the outer surface of the wall 63*a* between said flanges. The groove 63*aa* receives the wall portion 55*d* of coupling member 55 and couples member 55 to the hub 60 so that there is a sealing engagement or gripping between the nozzle and the coupling member. In addition, the downwardly facing surface of lower flange 63*bb* cooperates with spray device flange 37*aa* to hold the spray device down and prevent the spray device 37 from separating from the hub 60. A plurality of spaced fingers 65, for example, as shown at FIG. 4, a trio of radially inwardly-extending fingers spaced about 120° apart, are provided along wall portion 63*c*. The fingers 65 act as a stop for the coupling member 55 and prevent walls 55*b* and 55*c* from completely collapsing within the upper portion of the nozzle means 62 during periods when there is no flow of liquid under pressure through the coupling member. As shown at FIG. 2, the fingers 65 contact the inner surface of wall 55*b* during such periods and prevent the wall from collapsing into nozzle opening 62*b*.

During dishwashing operations, wash liquid is delivered under pressure from pump 32, upwardly through pump outlet 32*a*, and along bore 61*aa*, passing through lateral outlet apertures 61*b* and also through the axial passage of neck portion 62*a* into spray device 37 and coupling member 55 respectively. The spray device 37 is readily rotated about hub body 61 in response to the reaction force of liquid exiting through apertures 37*c*. The fluid pressure within coupling member 55 urges wall 55*b* upwardly so as to extend wall 55*c* to an expanded position, such as shown at FIG. 3, and into sealing contact with tower 51 at its open lower end 52. Pressurized wash liquid is then piped directly through the interior chamber 51*a* of tower 51 and through the apertures 53*b* to the chamber 39*a* of spray device 39. This wash liquid then exits under pressure through apertures 39*c*, rotating spray device 39 on tower 51 and applying a spray of wash liquid to the contents of the dishwasher.

An extremely economical dishwasher may be constructed in accordance with the principles of the invention since it is only necessary to include a plurality of racks for supporting dishes (or even only one rack) and the tower 51, along with the spray device 39 and the coupling member 55. Of course, such an economical dishwasher would also include other operative elements of a dishwasher, such as a cabinet, a pump, a heating element, a connecting means between the coupling member and the pump, etc. This type of dishwashing machine is also highly reliable and highly economical and enables wash liquid to be piped directly under its full pressure to a spray device mounted above a rack while allowing the rack to be withdrawn from the machine without interference.

Although a particular embodiment of the invention has been described and illustrated herein, it is recognized that modifications and variations may readily occur to those skilled in the art and consequently it is intended that the claims be interpreted to cover such modifications and equivalents.

The embodiments of the invention in which an exclusive property or privilege is claimed are defined as follows:

1. In an automatic dishwasher having lower and upper rotatable spray devices, a rack transversely movable between loading and operating positions and interposed between said lower and upper spray devices, and a pump having a pressurized water outlet, a wash liquid distribution system comprising:

a stationary hollow tower firmly attached in a vertical position upon said movable rack and having an annular wall member forming an internal fluid passage communicating between an open lower end of said tower and said upper spray devices;

a hollow stationary hub means fixedly attached to and communicating with said pump outlet upwardly of said lower spray devices and having a fluid passage aligned with said open lower end of said tower when said rack is in its said operating position, said hub means including a hub body and a nozzle member including a neck portion concentrically aligned within the axial bore of and attached to the upper portion of said hub body;

a stationary, expansible coupling member fixedly mounted upon said nozzle member and receiving fluid from said neck portion, said coupling member having an upper, inwardly-extending wall forming an axially-facing opening therein in a position communicable to said open lower end of said tower when said rack is in its operating position, said wall selectively sealingly engaging said annular wall member of said tower upon expansion of said coupling member, by a flow thereinto of pressurized wash liquid.

2. A wash liquid distribution system as defined in claim 1 wherein the nozzle member includes means for sealingly gripping the expansible coupling member.

3. A wash liquid distribution system as defined in claim 1, wherein said coupling member includes a flexible rubber-like material in the form of a bellows-like structure, said opening in the upper wall of the coupling member has a diameter smaller than the inner diameter of said open lower end of the tower, an annular outwardly curved side wall is joined to said upper wall and is expansible between a pressurized and a non-pressurized position in response to the presence of wash liquid under pressure within said coupling member, an axially extending side wall joined to said curved side wall is suitable for attachment to said hub means, and said upper wall of the coupling member is relatively thick in relation to said side walls of the coupling member.

4. A wash liquid distribution system as defined in claim 3, wherein said hub means includes upwardly-projecting fingers for supporting said upper wall of the coupling member in the non-pressurized position of said curved side wall of the coupling member.

5. In a dishwashing machine as defined in claim 1, wherein said rack comprises a lower rack spaced from an upper rack, the racks supporting dishes within said chamber, said wash liquid distribution system further defined by:

said tower having an apertured upper end;

said upper rotatable spray device located below said upper rack and within said washing chamber, said upper spray device including means for rotatably mounting said upper spray device on said apertured upper end of the stationary tower with the apertures of said upper end providing fluid communication between said stationary tower and said upper rotatable spray device;

a lower rotatable spray device located below said lower rack and within said washing chamber, said lower spray device including means for rotatably mounting said lower spray device on said stationary hub means; and said stationary hub means including an apertured side wall adjacent said upper opening thereof with the apertures of said side wall providing fluid communication between said stationary hub means and said lower rotatable spray device, whereby some wash liquid under pressure flowing from said pump means through said stationary hub means passes through the apertured side wall of said stationary hub means to thereby establish liquid flow to said rotatable lower spray device while some other wash liquid under pressure flowing from said pump means through said stationary hub means passes through said upper opening of said stationary hub means and into said stationary coupling member and expands said coupling member into sealing contact with said open lower end of the stationary tower to thereby establish liquid flow through said stationary tower to said rotatable upper spray device.

6. A wash liquid distribution system as defined in claim 1 wherein said stationary tower further comprises ear-like projections along outer walls of said tower in the vicinity of the apertured upper end of said tower for rotatably supporting said upper spray device; and said upper spray device includes upper and lower central openings for receiving the apertured upper end of said tower, said upper spray device including a lower downturned tab along the periphery of said lower central opening in said spray device for slidably contacting upfacing surfaces of said earlike projections along the upper wall of said tower and including flangelike projections along the periphery of said upper central opening in said upper spray device for slidably contacting at least a portion of the top surface of said upper end of the tower.

* * * * *